US005952596A

United States Patent [19]

Kondo

[11] Patent Number: 5,952,596

[45] Date of Patent: Sep. 14, 1999

[54] METHOD OF CHANGING TEMPO AND PITCH OF AUDIO BY DIGITAL SIGNAL PROCESSING

[75] Inventor: Kazunobu Kondo, Hamamatsu, Japan

[73] Assignee: Yamaha Corporation, Hamamatsu, Japan

[21] Appl. No.: 09/153,529

[22] Filed: Sep. 15, 1998

[30] Foreign Application Priority Data

Sep. 22, 1997 [JP] Japan ..... 9-256393

[51] Int. Cl.[6] ..... G10H 1/40; G10H 7/04; G10H 7/12

[52] U.S. Cl. ..... 84/605; 84/607; 84/612; 84/652; 84/DIG. 12

[58] Field of Search ..... 84/603–607, 612, 84/636, 652, 668, DIG. 12

[56] References Cited

U.S. PATENT DOCUMENTS

| | | | |
|---|---|---|---|
| 5,069,105 | 12/1991 | Iba et al. | 84/605 |
| 5,131,042 | 7/1992 | Oda | 84/605 X |
| 5,553,011 | 9/1996 | Fujita | 84/604 X |
| 5,567,901 | 10/1996 | Gibson et al. | 84/605 X |

*Primary Examiner*—Stanley J. Witkowski
*Attorney, Agent, or Firm*—Pillsbury Madison & Sutro LLP

[57] ABSTRACT

A pitch/tempo converting apparatus is constructed for concurrently changing a tempo and a pitch of an audio signal according to tempo designation information and pitch designation information. In the apparatus, a memory section memorizes the audio signal composed of original amplitude values sequentially sampled at original sampling points timed by an original sampling rate within an original frame period. A tempo converting section converts the original frame period into an actual frame period by varying a length of the original frame period according to the tempo designation information so as to change the tempo of the audio signal. A pitch converting section converts each of the original sampling points into each of actual sampling points by shifting each of the original sampling points according to the pitch designation information so as to change the pitch of the audio signal. An interpolating section calculates each of actual amplitude values at each of the actual sampling points by interpolating the original amplitude values sampled at original sampling points adjacent to the actual sampling point. A reading section sequentially reads the actual amplitude values by the original sampling rate during the actual frame period so as to reproduce a segment of the audio signal within the actual frame period. A connecting section smoothly connects a series of the segments reproduced by repetition of the actual frame period to thereby continuously change the tempo and the pitch of the audio signal.

8 Claims, 10 Drawing Sheets

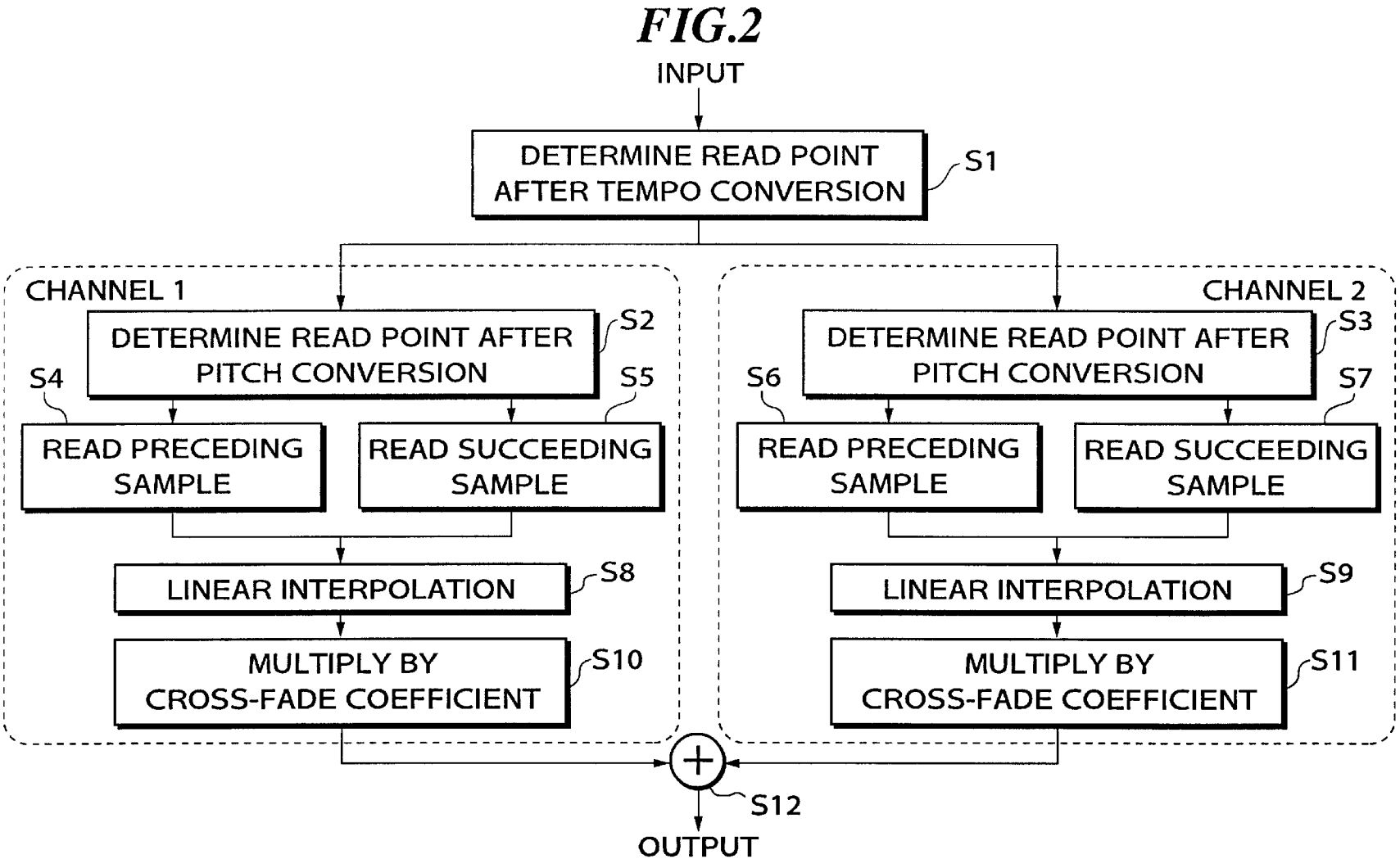
FIG.2
INPUT
S1
DETERMINE READ POINT AFTER TEMPO CONVERSION
CHANNEL 1
S2
DETERMINE READ POINT AFTER PITCH CONVERSION
S4
READ PRECEDING SAMPLE
S5
READ SUCCEEDING SAMPLE
S8
LINEAR INTERPOLATION
S10
MULTIPLY BY CROSS-FADE COEFFICIENT
CHANNEL 2
S3
DETERMINE READ POINT AFTER PITCH CONVERSION
S6
READ PRECEDING SAMPLE
S7
READ SUCCEEDING SAMPLE
S9
LINEAR INTERPOLATION
S11
MULTIPLY BY CROSS-FADE COEFFICIENT
S12
OUTPUT

METHOD OF CHANGING TEMPO AND PITCH OF AUDIO BY DIGITAL SIGNAL PROCESSING

BACKGROUND OF THE INVENTION

1. Field of the Invention

The present invention generally relates to a pitch/tempo converting method and a pitch/tempo converting apparatus for concurrently converting the pitch and tempo of an audio signal such as a music tone signal and a voice signal.

2. Description of Related Art

A cut and splice method is known as a typical pitch conversion technique for use in changing the pitch of a music tone or a voice. For example, as shown in FIG. 9, to lower the pitch of an original audio signal Si, the sample data reading speed or reading rate of sample values of the original audio signal Si is decreased to obtain a converted audio signal So. To raise the pitch of the original audio signal Si, the sample data reading speed is increased. Since the sample values are discrete digital data, a sample value B corresponding to the original sampling point in the converted audio signal So must be calculated from a shifted sample value A by means of linear interpolation or the like as shown in FIG. 10.

The calculated sample data is successively read at an original sampling interval without change, hence the tempo of the original audio signal Si also may change subsidiarily as a consequence of the pitch change. To prevent this from happening, a frame having a predetermined length T is defined as one processing unit as shown in FIG. 9. When the reading speed conversion of a predetermined number of samples has been completed in one frame, the same processing is repeated from a sample point jumped in the original audio signal Si. Consequently, by lowering the pitch while using the frame method, a part of the original audio signal Si is truncated. To raise the pitch, a part of the original audio signal Si is reproduced in duplication to compensate for the truncated part.

In a junction portion between consecutive frames, discontinuity of waveform of the audio signal occurs as shown in FIG. 9. This junction portion is smoothed by cross-fading. In the cross-fading, the reading start point of a frame of a first channel CH1 is shifted from that of another frame of a second channel CH2 by ½ of frame period T as shown in FIG. 11. The above-mentioned operations are executed to obtain the two channel audio signals. The two channel audio signals are multiplied by cross-fading coefficients cg1 and cg2, respectively, as shown in FIG. 11. The results of these multiplication operations are added together to smooth the junction of the successive frames.

Tempo conversion is conducted by changing the reproduction speed of a music tone or a voice. The conventional tempo conversion simply changes the read speed of digital sample data of the audio signal. In this simple tempo conversion, the change of the read speed subsidiarily causes a variation of the pitch. To prevent this variation from happening, pitch conversion that cancels the pitch variation of the original pitch must be combined with the tempo conversion. In this case too, interpolation is executed to calculate sample values after the pitch conversion.

When the tempo conversion is executed and the pitch conversion is additionally executed as with "quick reproduction+raised pitch," the pitch conversion is intended for not only correcting the pitch variation due to the tempo conversion but also positively raising the pitch. Therefore, conventionally, the pitch conversion and the tempo conversion are executed separately as shown in FIG. 12. As shown, in a pitch converting module, the read speeds of the two channels are modified based on the adjustive pitch conversion for correcting the pitch variation due to the tempo conversion and based on the net pitch conversion by a designated pitch (steps S21 and S22). Subsequently, interpolation is executed on each of the channels (steps S23 and S24), outputs of which are then cross-faded (step S25) with each other. In a tempo converting module, read speed change processing based on a designated tempo is executed on the pitch-converted data (step S26). Then, the interpolation is executed again in the resultant data (step S27).

In the conventional pitch/tempo conversion, the pitch conversion and the tempo conversion require separate interpolating operations. These two interpolating operations necessarily deteriorate the waveform of the audio signal, thereby lowering the quality of the reproduced audio signal. In addition, the conventional pitch/tempo conversion changes the read speeds separately in the pitch conversion and the tempo conversion. This causes redundant operations of the similar type, thereby presenting a problem of increased processing loads.

SUMMARY OF THE INVENTION

It is therefore an object of the present invention to provide a pitch/tempo converting method and a pitch/tempo converting apparatus that significantly reduce the amount of pitch/tempo conversion processing without causing much deterioration of waveform.

The inventive pitch/ tempo converting method controls a reproduction speed of an audio signal composed of original amplitude values sequentially sampled at discrete sampling points timed by an original sampling interval within a nominal frame period, thereby changing a tempo and a pitch of the audio signal by repetition of a frame period according to tempo designation information and pitch designation information. The inventive method comprises the steps of first determining temporary sampling points that are successively offset from corresponding ones of the discrete sampling points by varying the original sampling interval according to the tempo designation information, second determining an actual frame period that is altered from the nominal frame period as a result of varying the original sampling interval, first calculating an adjustive offset amount with respect to each temporary sampling point for canceling a subsidiary pitch variation which would be caused by the change of the tempo, second calculating a net offset amount with respect to each discrete sampling point for creating the change of the pitch specified by the pitch designation information, third determining each target sampling point that is offset from each temporary sampling point by a total of the adjustive offset amount and the net offset amount, third calculating each effective amplitude value of the audio signal at each target sampling point by interpolation of the original amplitude values, reading each effective amplitude value successively by the original sampling interval so as to effectively change the reproduction speed of the audio signal within one actual frame period, and switching one actual frame period smoothly to another actual frame period to thereby change the tempo and the pitch of the audio signal continuously by repetition of the actual frame period.

The inventive pitch/tempo converting apparatus is constructed for controlling a reproduction speed of an audio signal to concurrently change a tempo and a pitch of the audio signal according to tempo designation information and pitch designation information. In the inventive apparatus, a memory section memorizes the audio signal composed of original amplitude values sequentially sampled at discrete sampling points timed by an original sampling interval within a nominal frame period. A first determining section determines temporary sampling points that are successively offset from corresponding ones of the discrete sampling points by varying the original sampling interval according to the tempo designation information. A second determining section determines an actual frame period that is altered from the nominal frame period as a result of varying the original sampling interval. A first calculating section calculates an adjustive offset amount with respect to each temporary sampling point so as to cancel a subsidiary pitch variation which would be caused by the change of the tempo. A second calculating section calculates a net offset amount with respect to each discrete sampling point so as to create the change of the pitch specified by the pitch designation information. A third determining section determines each target sampling point that is offset from each temporary sampling point by a total of the adjustive offset amount and the net offset amount. A third calculating section calculates each effective amplitude value of the audio signal at each target sampling point by interpolation of the original amplitude values. A reading section successively reads each effective amplitude value based on the original sampling interval so as to effectively change the reproduction speed of the audio signal within one actual frame period. A switching section switches one actual frame period smoothly to another actual frame period to thereby change the tempo and the pitch of the audio signal continuously by repetition of the actual frame period.

According to the invention, each temporary sampling point of the original audio signal is obtained as a reference point when the sampling interval of the original audio signal is changed according to the tempo designation information. Each temporary sampling point is used as the reference point to determine each corresponding target sampling point shifted from each reference point by a displacement covering both of the adjustive offset amount for absorbing pitch variation caused by the tempo conversion and the net offset amount corresponding to the pitch variation specified by the pitch designation information. The amplitude value of the original audio signal at each target sampling point is obtained by interpolation from preceding and succeeding amplitude values of the target sampling point. The obtained amplitude value is outputted at the original sampling rate, thereby effectively changing the reproduction speed of the original audio signal. According to the invention, the pitch and tempo of the original audio signal can be converted by a single read speed converting operation and a single interpolation operation, resulting in a significantly reduced amount of data processing necessary for the pitch/tempo conversion. In addition, according to the invention, signal deterioration due to the interpolation is minimized to provide the audio signal of high quality. Further, since only a single interpolation operation is required, the reproduced audio signal is not so deteriorated by relatively simple linear interpolation, which in turn reduces the data processing amount.

The processing for smoothing the junction portion between successive frames is realized by means of a first signal conversion process and a second signal conversion process in parallel. The first signal conversion process is conducted for generating a first converted audio signal by executing the read speed change processing within a first actual frame having a time length altered according to the actual sampling interval changed based on the tempo designation information. The second signal conversion process is conducted for generating a second converted audio signal by executing the read speed change processing within a second actual frame shifted by ½ of the frame period T from the first frame. The first converted audio signal and the second converted audio signal are mixed with each other by executing the cross-fade process. At this moment, the frame length is altered from the original frame length since the sampling interval is changed based on the tempo designation information, thereby executing the tempo change processing concurrently during the pitch conversion processing.

BRIEF DESCRIPTION OF THE DRAWINGS

These and other objects of the invention will be seen by reference to the description, taken in connection with the accompanying drawings, in which:

FIG. 2 is a functional diagram indicative of pitch/tempo conversion processing in the above-mentioned embodiment;

DETAILED DESCRIPTION OF PREFERRED EMBODIMENTS

Figure 1:
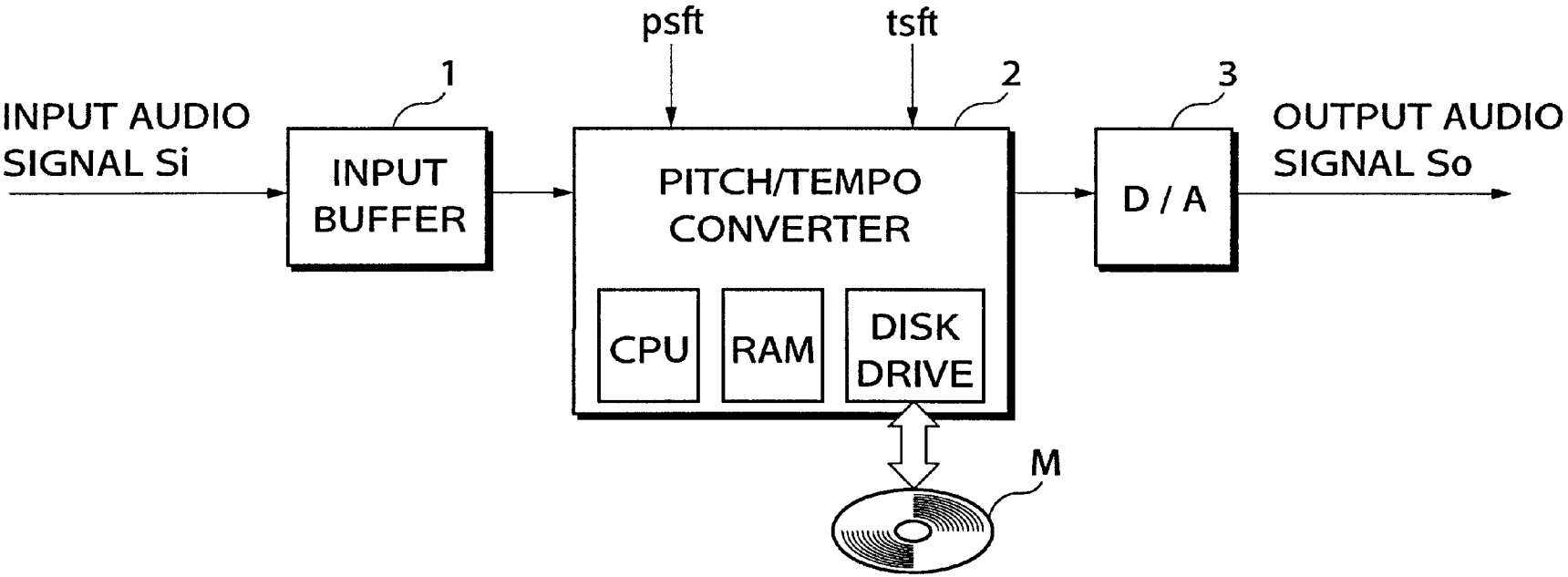
FIG. 1 is a block diagram illustrating a constitution of a pitch/tempo converting apparatus practiced as one preferred embodiment of the invention.

This invention will be described in further detail by way of example with reference to the accompanying drawings. Now referring to FIG. 1, there is shown a block diagram illustrating a constitution of an audio reproducing system to which a pitch/tempo conversion method practiced as one preferred embodiment is applied. As shown, a digital input audio signal of voice or music tone is sampled at a predetermined original sampling interval, and is stored in a memory in the form of an input buffer 1. The inputted digital signal is denoted as an original audio signal Si. A pitch/tempo converter 2 receives pitch designation information psft and tempo designation information tsft, and converts the pitch and tempo of the original audio signal Si based on these designation information psft and tsft. The pitch designation information psft is given in a unit of cent obtained by dividing a semitone by 100, which is obtained by dividing one octave by 12. For example, to lower the pitch by a semitone, psft=−100 is given as the pitch designation information. The tempo designation information tsft is given by a ratio with the tempo of the original audio signal being 1. For example, in order to raise the tempo by 1.2, tsft=1.2 is given as the tempo designation information. After the pitch and tempo have been converted by the pitch/tempo converter 2, the digital audio signal is converted by a D/A converter 3 into an analog audio signal denoted by an output audio signal So. Practically, the pitch/tempo converter 2 may be composed of a computer machine having a CPU, a RAM and a disk drive for receiving a machine readable medium M such as a CD-ROM.

FIG. 2 shows a functional diagram indicative of the processing to be executed by the pitch/tempo converter 2. First, a read point is temporarily determined in terms of a real value for the tempo conversion (section S1). Namely, each discrete sampling point of the original audio signal is shifted to each temporary sampling point as a reference point, which is determined when the original sampling interval of the original audio signal has been changed according to the tempo designation information tsft.

Figure 3:
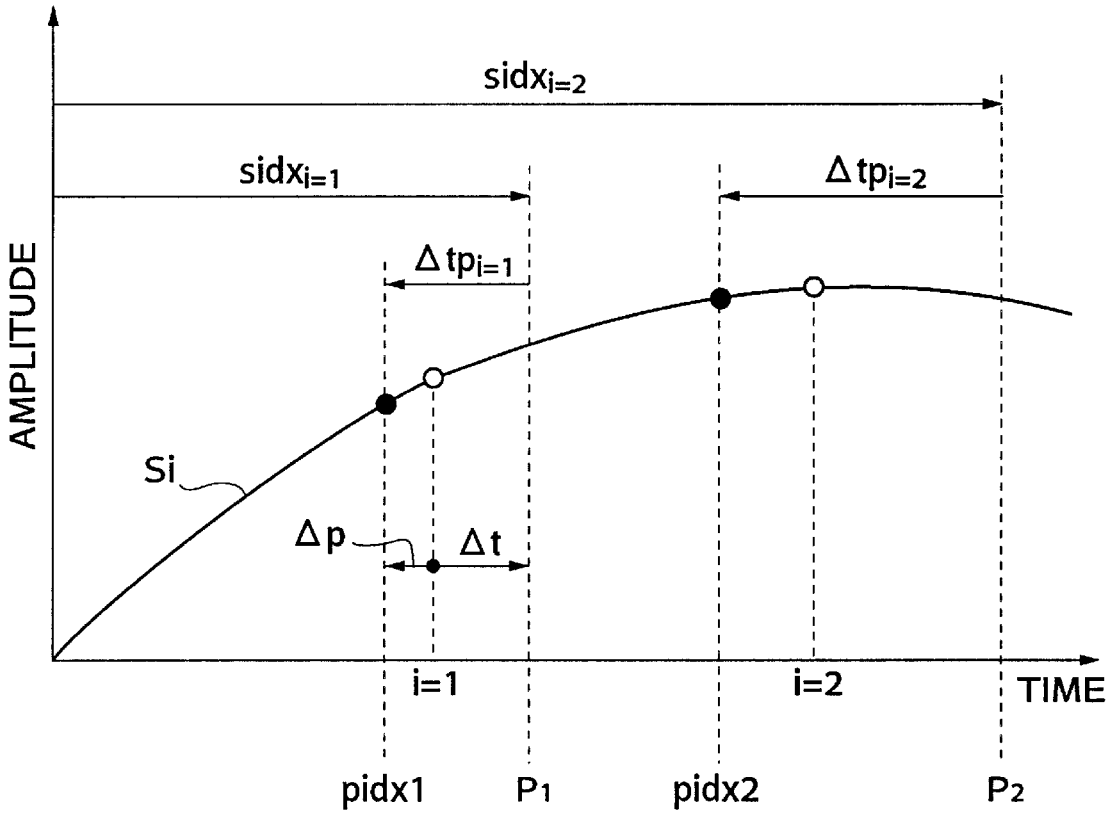
FIG. 3 is a diagram for describing a read point determining procedure in the processing shown in FIG. 2.

With reference to FIG. 3, for example, a first offset amount Δt due to the tempo conversion relative to the first original sampling point (i=1) of the original audio signal Si indicated by a first white dot is obtained from equation (1) below.

$$\Delta t = tsft - 1.0 \tag{1}$$

Each temporary sampling point or reference point Pi is obtained by accumulating this offset amount Δt for each original sampling point and by shifting the accumulated offset from each original sampling point.

Next, for each of cross-fade channels 1 and 2, an adjustive offset amount is calculated for canceling or absorbing a subsidiary pitch variation due to the tempo conversion with respect to each reference point Pi, and a net offset amount is calculated for creating the pitch variation specified by the pitch designation information psft (sections S2 and S3). The adjustive offset amount and the net offset amount are summed to determine a total offset amount Δtp. Let the frequency of the original audio signal be f and the frequency after the pitch conversion be f', then the pitch designation information psft is expressed by equation (2) below:

$$psft = 1200 \times \log 2\ (f'/f) \tag{2}$$

Therefore, the net offset amount Δp specified by the pitch designation information psft is given by equation (3) below in frequency ratio equivalent:

$$\Delta p = 2^{psft/1200} - 1.0 \tag{3}$$

Since the adjustive offset amount for canceling the subsidiary pitch variation due to the tempo conversion is denoted by −Δt, the total offset amount Δtp is given by equation (4) below:

$$\begin{aligned} \Delta tp &= \Delta p - \Delta t \\ &= (2^{psft/1200} - 1.0) - (tsft - 1.0) \\ &= 2^{psft/1200} - tsft \end{aligned} \tag{4}$$

Therefore, as shown in FIG. 3, each target sampling point pidx indicated by a black dot with the adjustive and net offset amounts considered is obtained by accumulating the total offset amount Δtp for each sampling point and by shifting the accumulated offset from each reference point Pi.

Figure 4:
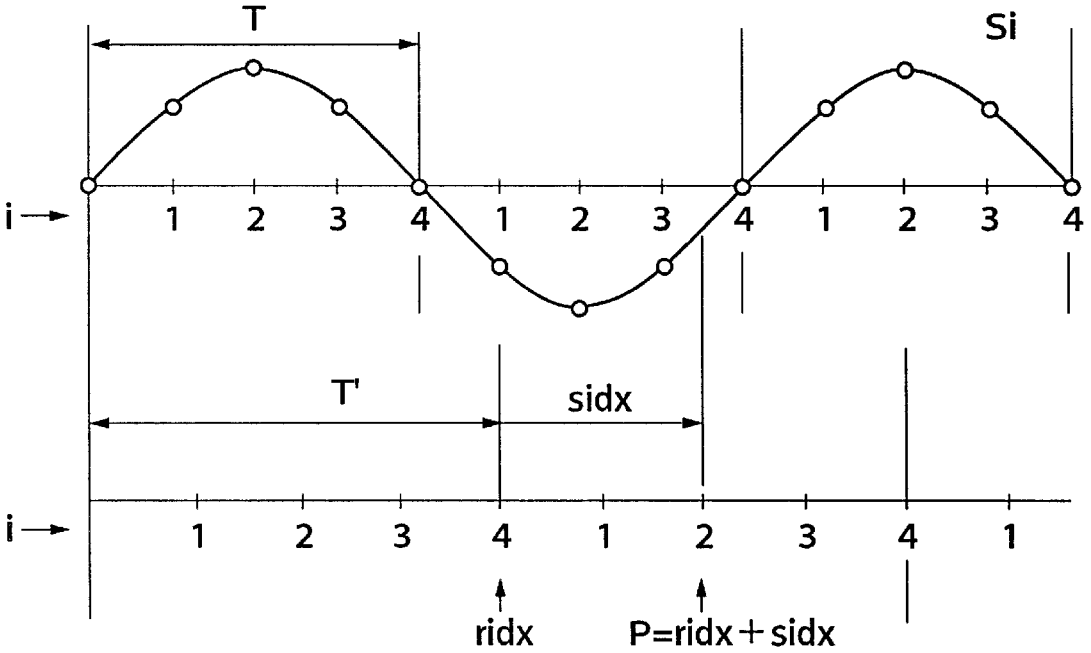
FIG. 4 is a diagram illustrating a method of determining a reference point in the processing shown in FIG. 2.

Conventionally, this pitch conversion is executed for every of nominal frames having a time length T determined with reference to the original audio signal Si shown in FIG. 4. According to the present invention, the pitch/tempo conversion is executed in units of an actual frame having a length T' (=T×tsft) considering alteration of the sampling interval due to the tempo conversion. Accordingly, the reference point P currently in processing is identified from ridx+sidx, where ridx is the start point of the actual frame currently in processing and sidx designates a local point in this frame.

The start point ridx is updated by ridx=ridx+T' every time the processing has been completed for one frame. The local reference point sidx in the current frame under the tempo conversion is obtained by i*tsft by incrementing i from 1 to T where i denotes a sample number in the frame indicated by ridx. Then, the actual target sampling point pidx with the pitch conversion also considered is obtained from equation (5) below:

$$pidx = ridx + sidx + \Delta pt \tag{5}$$

Thus, the processing operation (sections S1 through S3) can be executed collectively for determining the target sampling point or actual read point pidx considering both of the tempo conversion and the pitch conversion.

The determined target sampling point pidx is generally not a discrete integer number but a real number. The original amplitude values located at the original discrete sampling points before and after the target sampling point pidx are read (sections S4 through S7) to obtain the effective amplitude value at the target sampling point pidx by linear interpolation (sections S8 and S9). Let j-th original amplitude value of the original audio signal Si be d(j), then the effective amplitude value dt is obtained from equation (6) below:

$$dt = d\{\mathrm{int}(pidx)\} + [d\{\mathrm{int}(pidx)+1\} - d\{\mathrm{int}(pidx)\}]^{*}\{pidx - int(pidx)\} \tag{6}$$

where int(pidx) indicates the integer part of pidx.

Figure 5A:
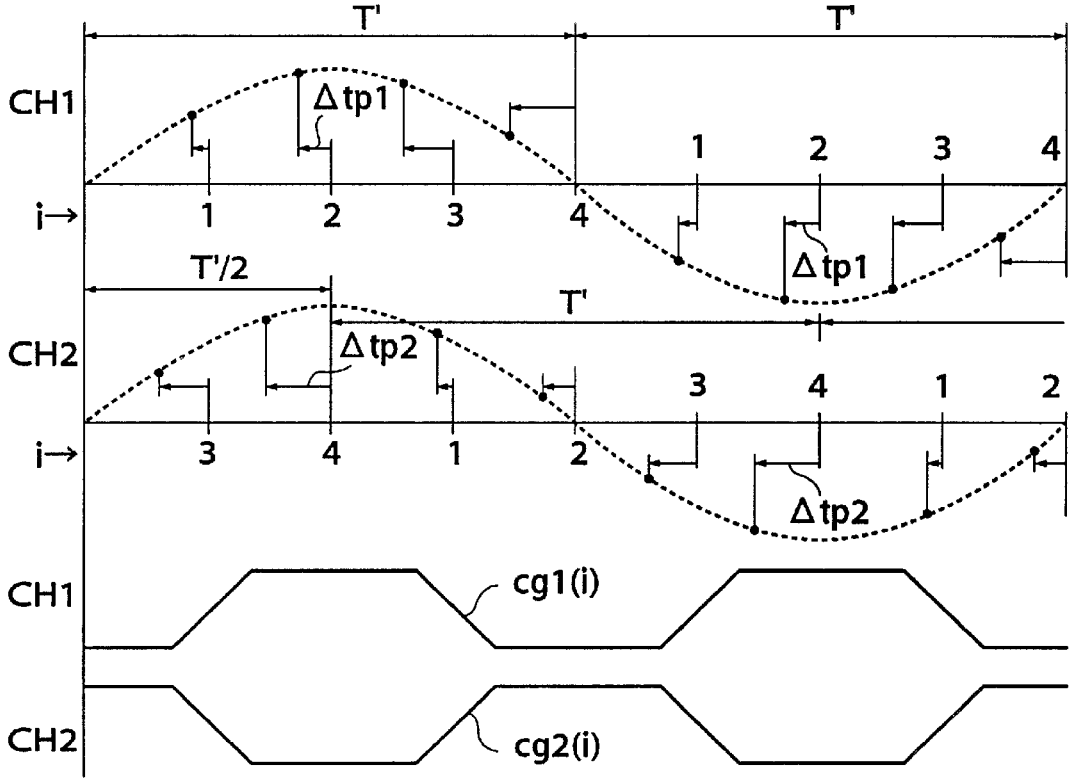
FIGS. 5A and 5B are diagrams for describing cross-fading in the processing shown in FIG. 2.

Finally, the effective amplitude value dt is multiplied by a cross-fade coefficient (sections S10 and S11). Then, the results of the multiplication of the two channels are added together to reproduce the audio signal converted in both of pitch and tempo (section S12). Namely, as shown in FIG. 5A, in order to execute the cross-fading, the frames must be shifted by just T'/2 between the channels 1 and 2. Hence, the total offset amount Δtp Δtp1 Δtp2 at corresponding sampling points in the channels 1 and 2 due to the phase shift of T'/2, as shown in FIG. 5A. For realizing the phases shift,as shown in FIG. 5A, the ridx is shifted by just T'/2 between the channels 1 and 2, and the reference points are also shifted just by that amount T'/2.

Figure 5B:
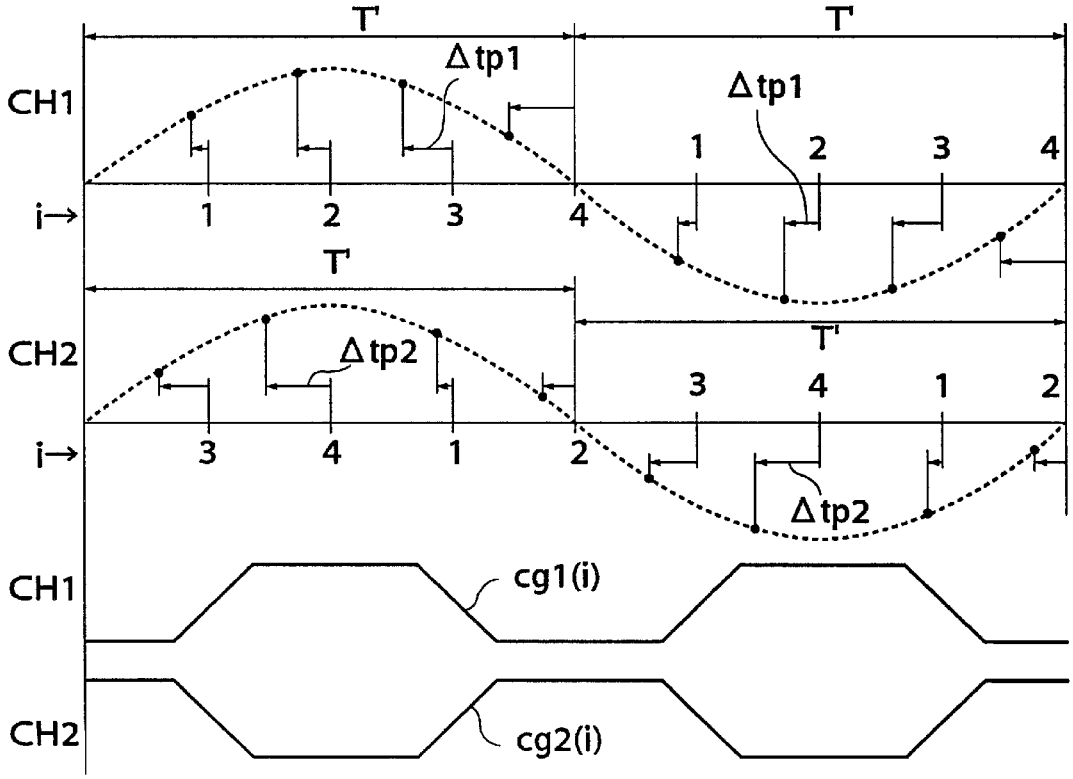

Alternatively, a function Δtp1(i) of channel 1 and a function Δtp2(i) of channels 2 may be obtained beforehand separately as shown in FIG. 5B with Δtp as a function of sampling number i while eliminating the frame shift between the channels 1 and 2. For example, if the tempo is raised by 1.2, the pitch is reduced by 100 cent and the frame length T is 6, then Δtp1(i) and Δtp2(i) are calculated as follows:

| i | Δtp1(i) | Δtp2(i) |
|---|---|---|
| 1 | −0.2561 | −1.0245 |
| 2 | −0.5123 | −1.2806 |
| 3 | −0.7684 | −1.5368 |
| 4 | −1.0245 | −0.2561 |
| 5 | −1.2806 | −0.5123 |
| 6 | −1.5368 | −0.7684 |

Cross-fade coefficient cg is also obtained beforehand as cg1(i) and cg2(i) for the channels 1 and 2, respectively, as shown in FIG. 5B. This processing can synchronize the frames of the channels 1 and 2 with each other, thereby eliminating the need for making a phase shift by ½ of one frame period when cross-fading the audio signals of the two channels. This provides advantages that no temporary buffer for the phase shifting is required and, at the same time, the conversion processing is simplified.

Referring back again to FIGS. 1 through 3, the inventive pitch/tempo converting apparatus is constructed for controlling a reproduction speed of an audio signal Si to concurrently change a tempo and a pitch of the audio signal Si according to tempo designation information tsft and pitch designation information psft. In the inventive apparatus, a memory section in the form of the input buffer 1 memorizes the audio signal Si composed of original amplitude values sequentially sampled at discrete sampling points (i=1, 2, . . . ) timed by an original sampling interval within a nominal frame period T a first determining section (section S1) determines temporary sampling points P that are successively offset from corresponding ones of the discrete sampling points i by varying the original sampling interval according to the tempo designation information. A second determining section (section S1) determines an actual frame period T' that is altered from the nominal frame period T as a result of varying the original sampling interval. A first calculating section (section S2) calculates an adjustive offset amount Δt with respect to each temporary sampling point P so as to cancel a subsidiary pitch variation which would be caused by the change of the tempo. A second calculating section (section S2) calculates a net offset amount Δp with respect to each discrete sampling point i so as to create the change of the pitch specified by the pitch designation information. A third determining section (section S2) determines each target sampling point pidx that is offset from each temporary sampling point P by a total Δtp of the adjustive offset amount Δt and the net offset amount Δp. A third calculating section (section S8) calculates each effective amplitude value of the audio signal Si at each target sampling point pidx by interpolation of the original amplitude values. A reading section (sections S4 and S5) successively reads each effective amplitude value based on the original sampling interval so as to effectively change the reproduction speed of the audio signal Si within one actual frame period T'. A switching section (section S10–S12) switches one actual frame period smoothly to another actual frame period to thereby change the tempo and the pitch of the audio signal continuously by repetition of the actual frame period T'.

In a different view of the invention, the pitch/tempo converting apparatus is constructed for concurrently changing a tempo and a pitch of an audio signal Si according to tempo designation information tsft and pitch designation information psft. In the inventive apparatus, a memory section (input buffer 1) memorizes the audio signal Si composed of original amplitude values sequentially sampled at original sampling points i timed by an original sampling rate within an original frame period T. A tempo converting section S1 converts the original frame period T into an actual frame period T' by varying a length of the original frame period according to the tempo designation information tsft so as to change the tempo of the audio signal. A pitch converting section S2 converts each of the original sampling points i into each of actual sampling points pidx by shifting each of the original sampling points i according to the pitch designation information psft so as to change the pitch of the audio signal. An interpolating section S8 calculates each of actual amplitude values at each of the actual sampling points pidx by interpolating the original amplitude values sampled at original sampling points i adjacent to the actual sampling point pidx. A reading section S10 sequentially reads the actual amplitude values by the original sampling rate during the actual frame period T' so as to reproduce a segment of the audio signal within the actual frame period T'. A connecting section S12 smoothly connects a series of the segments reproduced by repetition of the actual frame period T' to thereby continuously change the tempo and the pitch of the audio signal.

Preferably, the connecting section S12 smoothly connects a first segment and a second segment by cross-fading such that the first segment and the second segment alternately fade in and out while a phase of reading of the actual amplitude values is reversed between the first segment and the second segment. The interpolating section S8 calculates each of the actual amplitude values by linearly interpolating a pair of the original amplitude values sampled at a pair of the original sampling points between which the actual sampling point exists.

Figure 6:
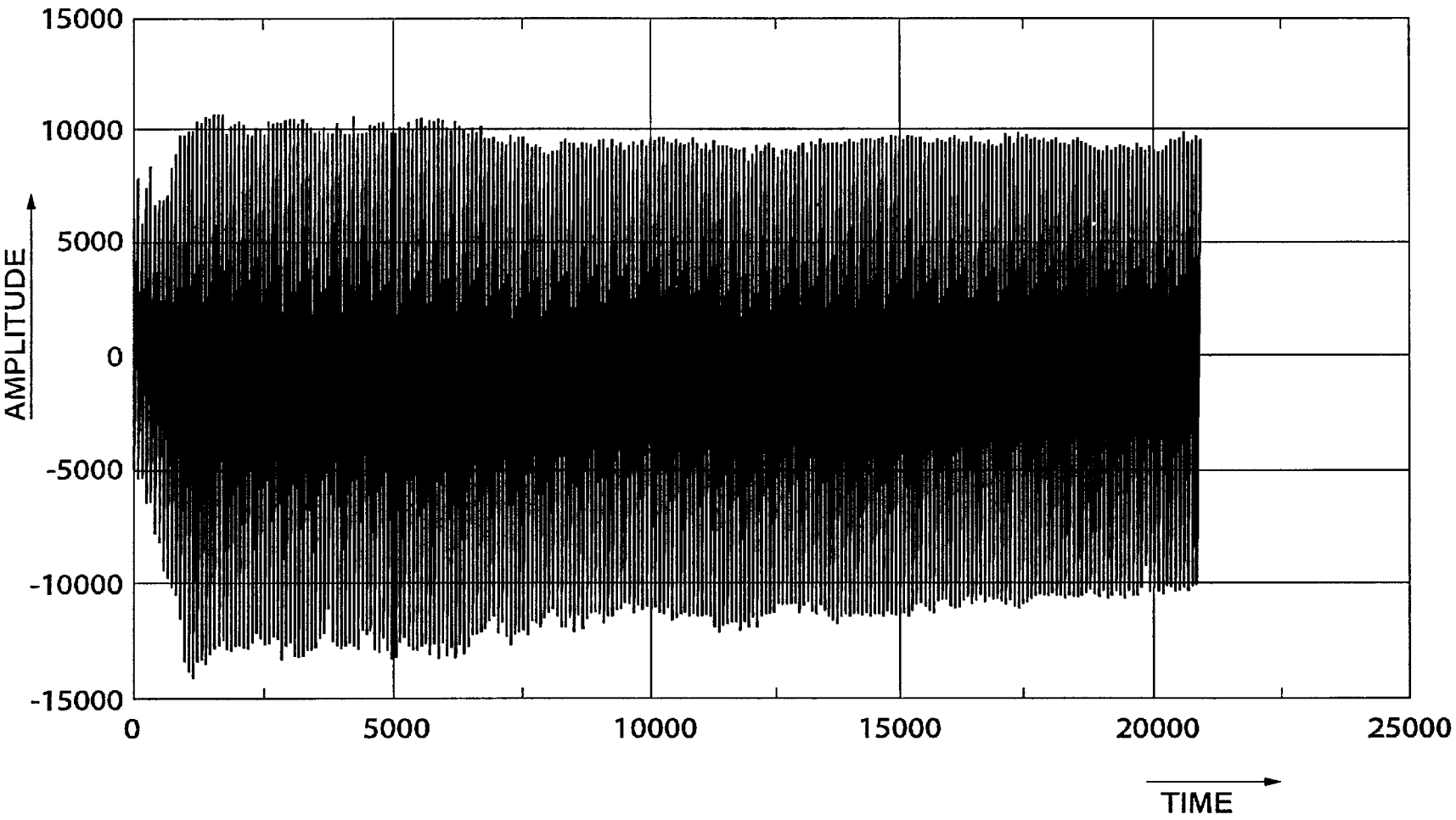
FIG. 6 is a waveform diagram illustrating an example of an original audio signal.
Figure 7:
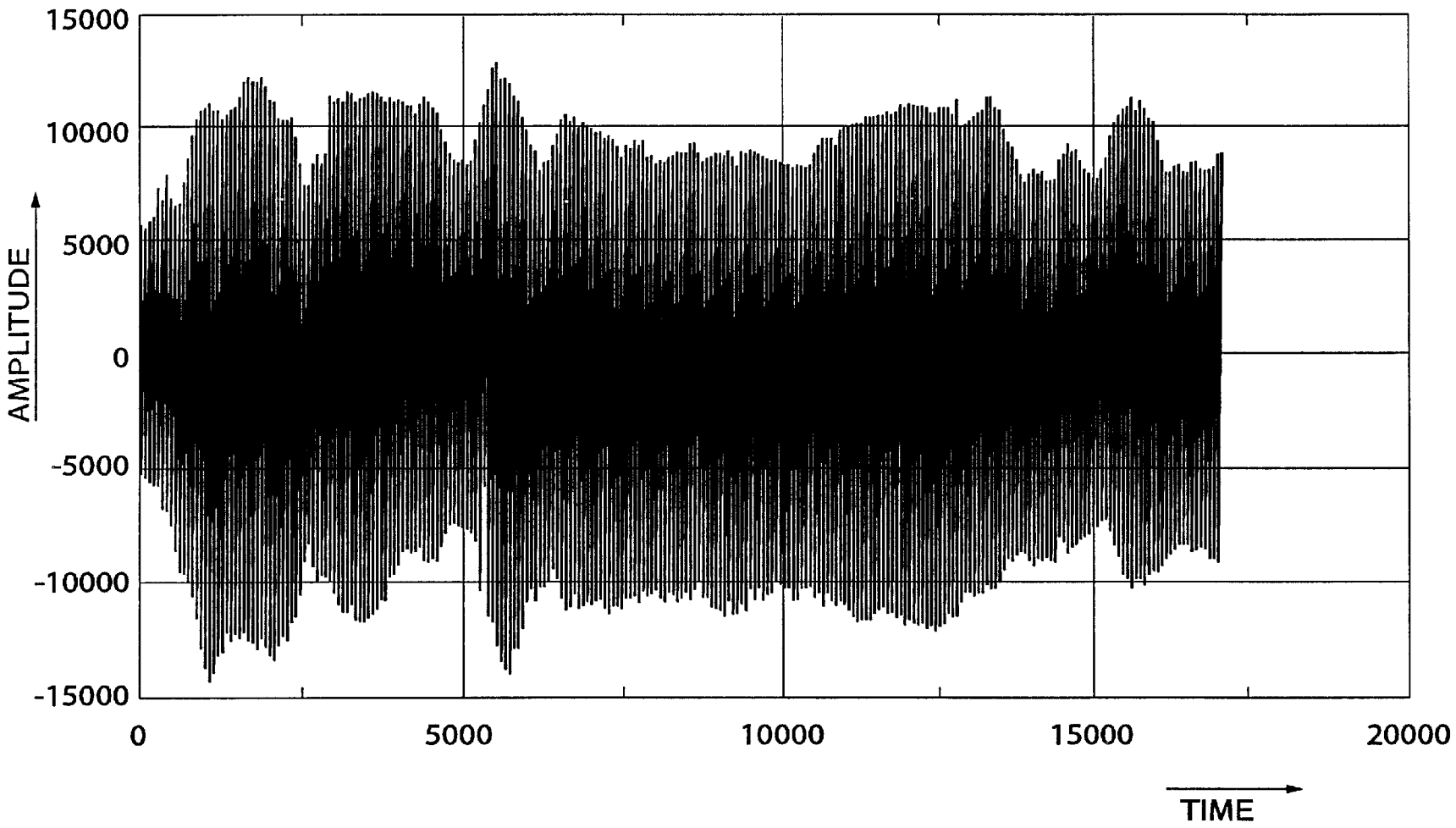
FIG. 7 is a waveform diagram illustrating a waveform obtained by executing pitch/tempo conversion based on a conventional method.
Figure 8:
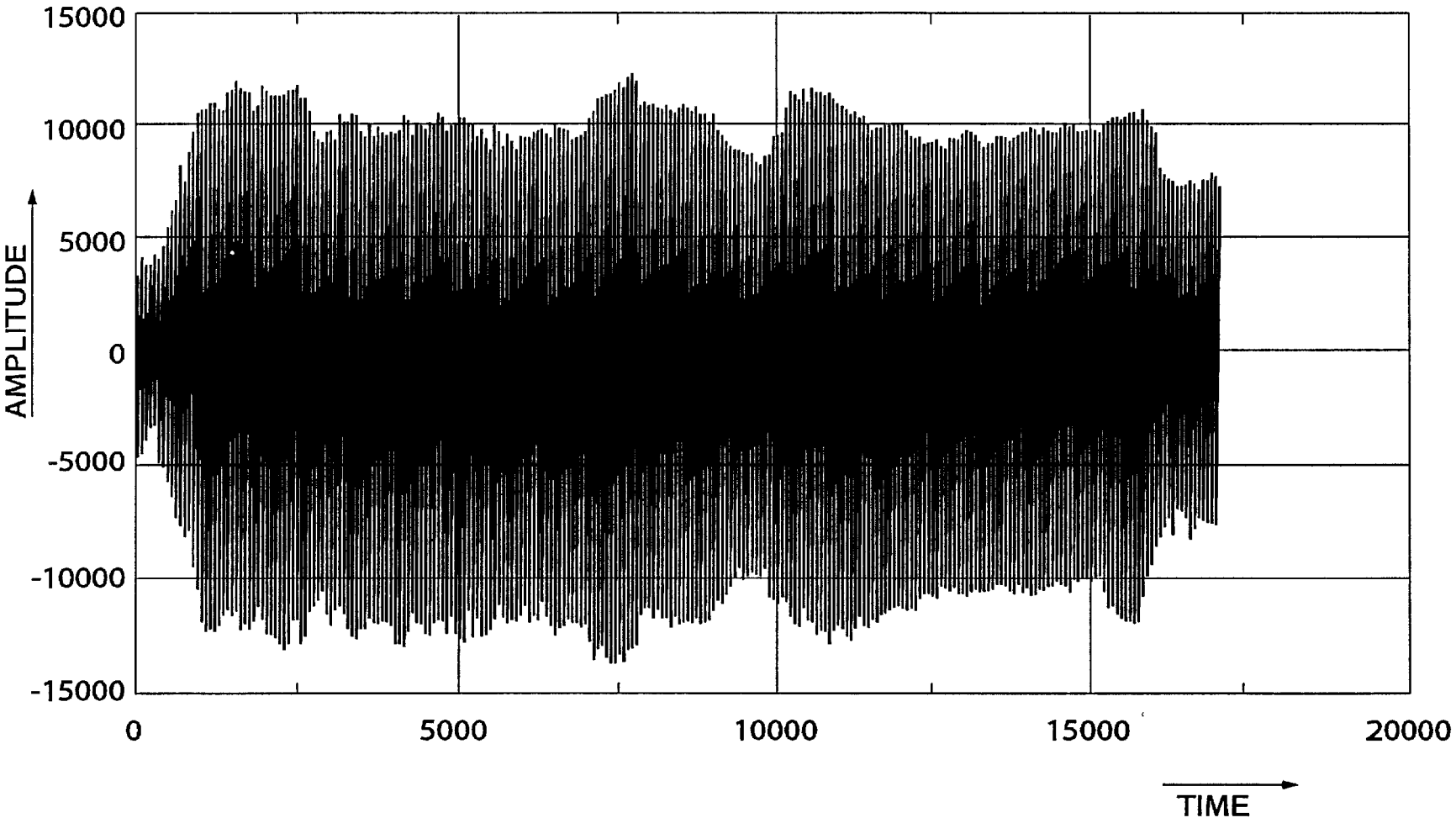
FIG. 8 is a waveform diagram illustrating a waveform obtained by executing pitch/tempo conversion based on a method according to the present invention.
Figure 9:
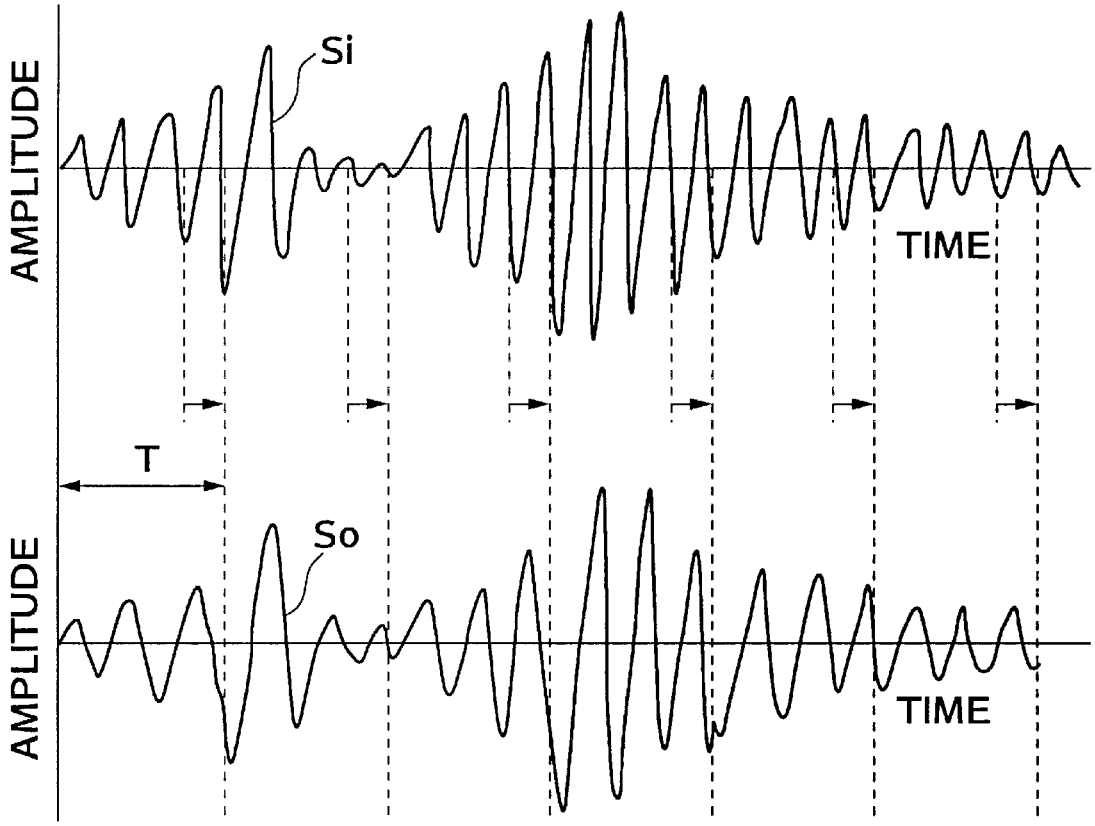
FIG. 9 is a waveform diagram for describing a conventional pitch conversion method.
Figure 10:
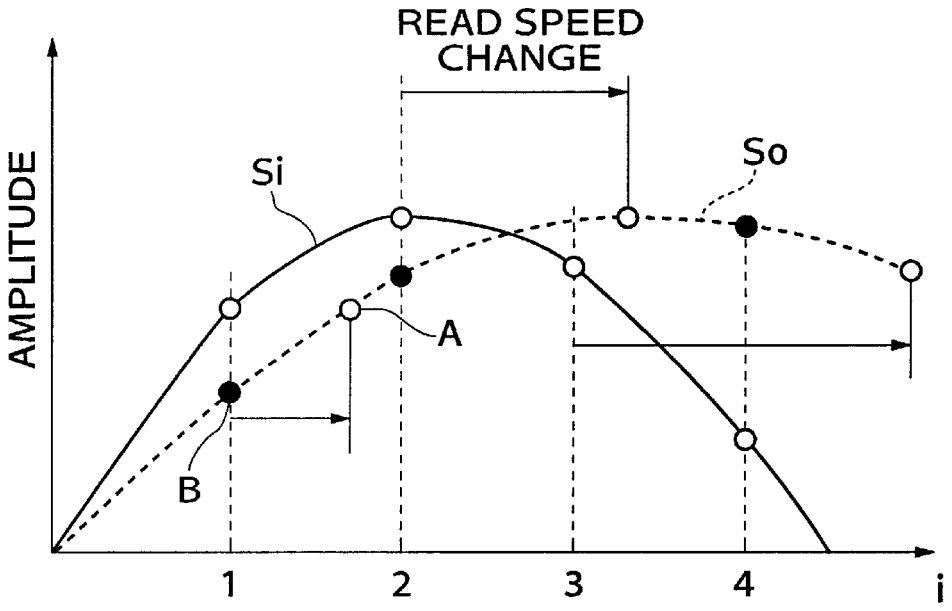
FIG. 10 is a diagram for describing interpolation processing in the conventional pitch conversion method.
Figure 11:
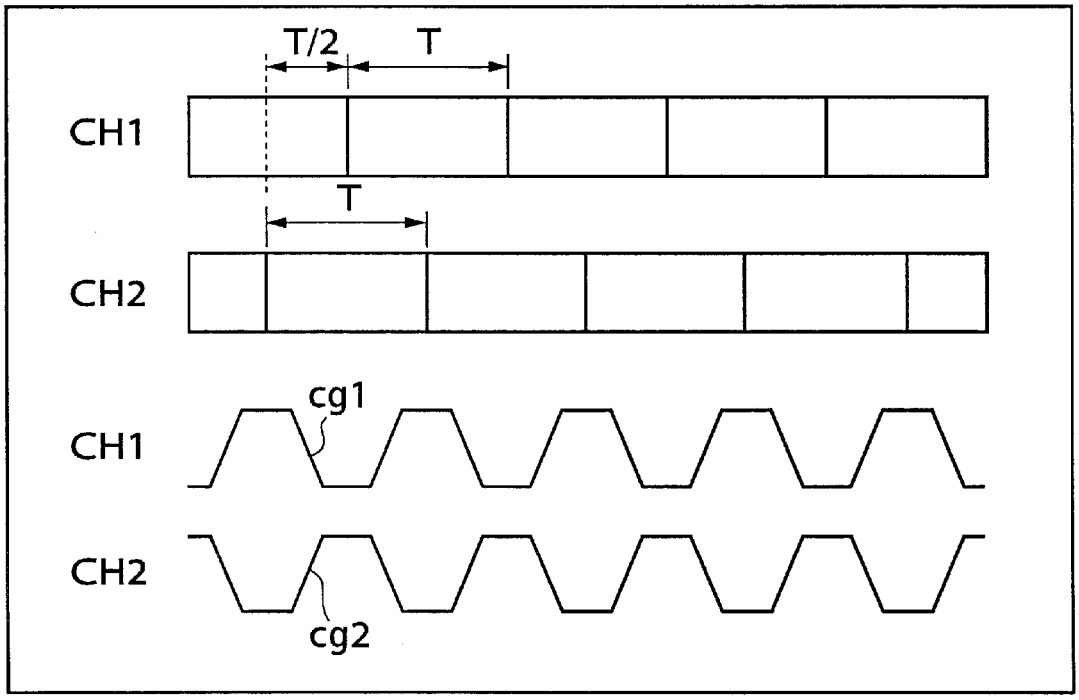
FIG. 11 is a diagram for describing cross-fading in the conventional pitch conversion method.
Figure 12:
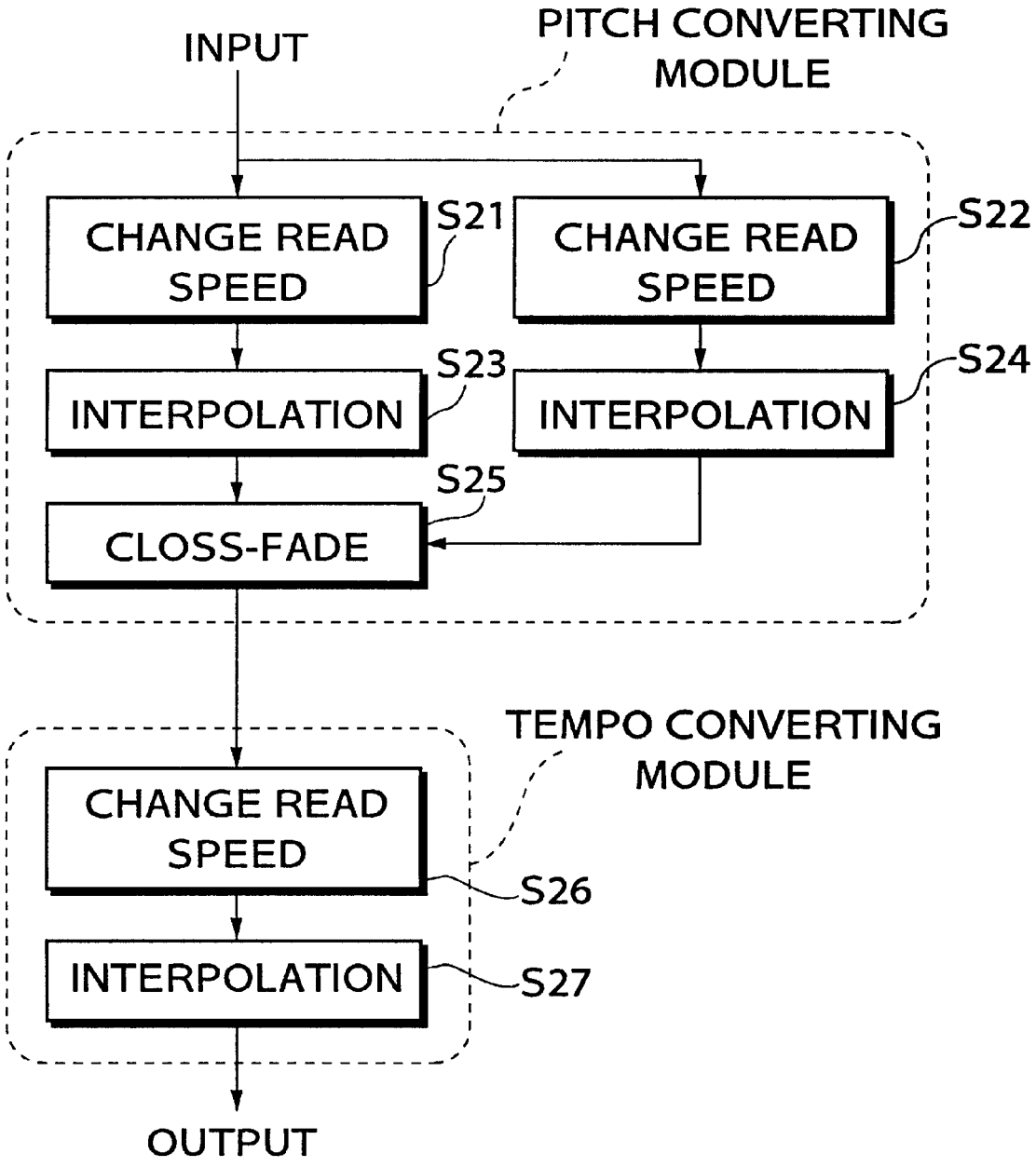
FIG. 12 is a flowchart indicative of conventional pitch/tempo conversion processing.

FIGS. 6 through 8 are waveform diagrams for describing effects of the inventive pitch/tempo conversion method. FIG. 6 represents the waveform of an original audio signal. FIG. 7 represents the waveform of a processed audio signal obtained by increasing the pitch of the signal of FIG. 6 by 300 cent and by increasing the tempo by 1.25 in the conventional method. FIG. 8 represents the waveform of a processed audio signal obtained by executing the same pitch/tempo conversion on the signal of FIG. 6 according to the method of the present invention. These waveform diagrams indicate that, while the waveform of the original audio signal of FIG. 6 does not have much variation in waveform envelope, the waveform envelope of the signal converted in pitch and tempo by the conventional method presents a considerable variation as shown in FIG. 7. With this respect, the method according to the present invention significantly suppresses the variation in waveform envelope as shown in FIG. 8, thereby proving that the present invention is extremely effective in the high quality reproduction of the audio signal.

It should be noted that the present invention is not limited to the above-mentioned preferred embodiment. In the above-mentioned preferred embodiment, the linear interpolation is used for the interpolation processing of the amplitude values. It is obvious that a high-level interpolating technique such as Lagrange's interpolation may be used for higher interpolation precision. This, coupled with a fact that the interpolation processing may be executed only once, results in the processing of extremely high precision.

The above-mentioned processing is realized by a pitch/tempo conversion program executed in the computer machine of the pitch/tempo converter 2. Such a program is provided by means of an appropriate machine readable medium M such as a floppy disk or a CD-ROM, or through an appropriate communication medium. The machine readable medium M is used in the tempo and pitch converter 2 having a CPU for controlling a reproduction speed of an audio signal composed of original amplitude values sequentially sampled at discrete sampling points timed by an original sampling interval within a nominal frame period, thereby changing a tempo and a pitch of the audio signal by repetition of a frame period according to tempo designation information and pitch designation information. The medium M contains program instructions executable by the CPU for causing the tempo and pitch converter 2 to perform the method comprising the steps of first determining temporary sampling points that are successively offset from corresponding ones of the discrete sampling points by varying the original sampling interval according to the tempo designation information, second determining an actual frame period that is altered from the nominal frame period as a result of varying the original sampling interval, first calculating an adjustive offset amount with respect to each temporary sampling point for canceling a subsidiary pitch variation which would be caused by the change of the tempo, second calculating a net offset amount with respect to each discrete sampling point for creating the change of the pitch specified by the pitch designation information, third determining each target sampling point that is offset from each temporary sampling point by a total of the adjustive offset amount and the net offset amount, third calculating each effective amplitude value of the audio signal at each target sampling point by interpolation of the original amplitude values, reading each effective amplitude value successively by the original sampling interval so as to effectively change the reproduction speed of the audio signal within one actual frame period, and switching one actual frame period smoothly to another actual frame period to thereby change the tempo and the pitch of the audio signal continuously by repetition of the actual frame period.

As described and according to the invention, a total offset amount is calculated to contain an adjustive or compensative offset amount for absorbing a subsidiary pitch variation caused by the tempo conversion and a net offset amount specified by the pitch designation information. The total offset amount is calculated with reference to each reference point of an original audio signal, obtained when a sampling interval of the original audio signal has been changed based on the tempo designation information. Amplitude value of the original audio signal at each target sampling point corrected by this total shift amount with respect to each reference point is obtained from original amplitude values at preceding and succeeding original sampling points around the target sampling point through interpolation. The obtained amplitude value is outputted at the original sampling rate, thereby effectively changing the reproduction speed of the original audio signal. In the novel constitution, the pitch and tempo of the original audio signal can be converted only by a single read speed converting operation and a single interpolation processing operation, thereby significantly reducing the processing amount as compared with the conventional arrangement. Further, the novel constitution reduces the signal deterioration due to redundant interpolation, thereby providing the reproduced audio signals of high quality.

While the preferred embodiment of the present invention has been described using specific terms, such description is for illustrative purposes only, and it is to be understood that changes and variations may be made without departing from the spirit or scope of the appended claims.

What is claimed is:

1. A method of controlling a reproduction speed of an audio signal composed of original amplitude values sequentially sampled at discrete sampling points timed by an original sampling interval within a nominal frame period, thereby changing a tempo and a pitch of the audio signal by repetition of a frame period according to tempo designation information and pitch designation information, the method comprising the steps of:

first determining temporary sampling points that are successively offset from corresponding ones of the discrete sampling points by varying the original sampling interval according to the tempo designation information;

second determining an actual frame period that is altered from the nominal frame period as a result of varying the original sampling interval;

first calculating an adjustive offset amount with respect to each temporary sampling point for canceling a subsidiary pitch variation which would be caused by the change of the tempo;

second calculating a net offset amount with respect to each discrete sampling point for creating the change of the pitch specified by the pitch designation information;

third determining each target sampling point that is offset from each temporary sampling point by a total of the adjustive offset amount and the net offset amount;

third calculating each effective amplitude value of the audio signal at each target sampling point by interpolation of the original amplitude values;

reading each effective amplitude value successively by the original sampling interval so as to effectively change the reproduction speed of the audio signal within one actual frame period; and switching one actual frame period smoothly to another actual frame period to thereby change the tempo and the pitch of the audio signal continuously by repetition of the actual frame period.

2. The method as claimed in claim 1, wherein the switching step comprises switching one actual frame period smoothly to another actual frame period by cross-fading such that said one actual frame period and said another actual frame period alternately fade in and out while a phase of the reading step is reversed between said one actual frame period and said another actual frame period.

3. The method as claimed in claim 1, wherein the third calculating step comprises calculating the effective amplitude value at the target sampling point by interpolation of a pair of the original amplitude values sampled at a pair of the discrete sampling points between which the target sampling point exists.

4. An apparatus for controlling a reproduction speed of an audio signal to concurrently change a tempo and a pitch of the audio signal according to tempo designation information and pitch designation information, the apparatus comprising:

a memory section that memorizes the audio signal composed of original amplitude values sequentially sampled at discrete sampling points timed by an original sampling interval within a nominal frame period, a first determining section that determines temporary sampling points that are successively offset from corresponding ones of the discrete sampling points by varying the original sampling interval according to the tempo designation information;

a second determining section that determines an actual frame period that is altered from the nominal frame period as a result of varying the original sampling interval;

a first calculating section that calculates an adjustive offset amount with respect to each temporary sampling point so as to cancel a subsidiary pitch variation which would be caused by the change of the tempo;

a second calculating section that calculates a net offset amount with respect to each discrete sampling point so as to create the change of the pitch specified by the pitch designation information;

a third determining section that determines each target sampling point which is offset from each temporary sampling point by a total of the adjustive offset amount and the net offset amount;

a third calculating section that calculates each effective amplitude value of the audio signal at each target sampling point by interpolation of the original amplitude values;

a reading section that successively reads each effective amplitude value based on the original sampling interval so as to effectively change the reproduction speed of the audio signal within one actual frame period; and a switching section that switches one actual frame period smoothly to another actual frame period to thereby change the tempo and the pitch of the audio signal continuously by repetition of the actual frame period.

5. A machine readable medium for use in a tempo and pitch converter having a CPU for controlling a reproduction speed of an audio signal composed of original amplitude values sequentially sampled at discrete sampling points timed by an original sampling interval within a nominal frame period, thereby changing a tempo and a pitch of the audio signal by repetition of a frame period according to tempo designation information and pitch designation information, the medium containing program instructions executable by the CPU for causing the tempo and pitch converter to perform the method comprising the steps of:

first determining temporary sampling points that are successively offset from corresponding ones of the discrete sampling points by varying the original sampling interval according to the tempo designation information;

second determining an actual frame period that is altered from the nominal frame period as a result of varying the original sampling interval;

first calculating an adjustive offset amount with respect to each temporary sampling point for canceling a subsidiary pitch variation which would be caused by the change of the tempo;

second calculating a net offset amount with respect to each discrete sampling point for creating the change of the pitch specified by the pitch designation information;

third determining each target sampling point that is offset from each temporary sampling point by a total of the adjustive offset amount and the net offset amount;

third calculating each effective amplitude value of the audio signal at each target sampling point by interpolation of the original amplitude values;

reading each effective amplitude value successively based on the original sampling interval so as to effectively change the reproduction speed of the audio signal within one actual frame period; and switching one actual frame period smoothly to another actual frame period to thereby change the tempo and the pitch of the audio signal continuously by repetition of the actual frame period.

6. An apparatus for concurrently changing a tempo and a pitch of an audio signal according to tempo designation information and pitch designation information, the apparatus comprising:

a memory section that memorizes the audio signal composed of original amplitude values sequentially sampled at original sampling points timed by an original sampling rate within an original frame period;

a tempo converting section that converts the original frame period into an actual frame period by varying a length of the original frame period according to the tempo designation information so as to change the tempo of the audio signal;

a pitch converting section that converts each of the original sampling points into each of actual sampling points by shifting each of the original sampling points according to the pitch designation information so as to change the pitch of the audio signal;

an interpolating section that calculates each of actual amplitude values at each of the actual sampling points by interpolating the original amplitude values sampled at original sampling points adjacent to the actual sampling point;

a reading section that sequentially reads the actual amplitude values by the original sampling rate during the actual frame period so as to reproduce a segment of the audio signal within the actual frame period; and a connecting section that smoothly connecting a series of the segments reproduced by repetition of the actual frame period to thereby continuously change the tempo and the pitch of the audio signal.

7. The apparatus as claimed in claim 6, wherein the connecting section smoothly connects a first segment and a second segment by cross-fading such that the first segment and the second segment alternately fade in and out while a phase of reading of the actual amplitude values is reversed between the first segment and the second segment.

8. The apparatus as claimed in claim 6, wherein the interpolating section calculates each of the actual amplitude values by linearly interpolating a pair of the original amplitude values sampled at a pair of the original sampling points between which the actual sampling point exists.

* * * * *